US006096102A

United States Patent [19]

Matthäi et al.

[11] Patent Number: 6,096,102

[45] Date of Patent: Aug. 1, 2000

[54] KERZE (CANDLE)

[75] Inventors: Michael Matthäi, Henstedt-Ulzburg; Gernot Meyer, Hamburg; Bernd Laudi, Gockels, all of Germany

[73] Assignee: Schümann Sasol GmbH & Co. KG, Hamburg, Germany

[21] Appl. No.: 09/251,206

[22] Filed: Feb. 16, 1999

[51] Int. Cl.[7] ..... C10L 5/00

[52] U.S. Cl. ..... 44/275; 431/288

[58] Field of Search ..... 44/275; 431/288

[56] References Cited

U.S. PATENT DOCUMENTS 3,843,312 10/1974 Easterday ..... 44/275
4,110,261 8/1978 Newland ..... 44/275

FOREIGN PATENT DOCUMENTS 9634077 10/1996 WIPO .
9708282 3/1997 WIPO .

*Primary Examiner*—Jacqueline V. Howard
*Assistant Examiner*—Cephia D. Toomer
*Attorney, Agent, or Firm*—Martin A. Farber

[57] ABSTRACT

A candle comprising candle base materials of a variety of kinds, on the one hand of a candle base material of a first kind which consists in part of white oil and of copolymer, synthetic paraffin being further contained as a constituent, in particular of chain length C18 to C20, and on the other hand of a candle base material of a second kind consisting of conventional paraffin derived from crude paraffins. The different candle base materials are arranged one over the other in a layered manner.

20 Claims, 1 Drawing Sheet

KERZE (CANDLE)

FIELD AND BACKGROUND OF THE INVENTION

The invention relates to a candle from candle base materials of a variety of kinds.

It is already known to provide candles from a transparent, gel-like candle base material, see for example U.S. Pat. No. 5,879,694 and U.S. Pat. No. 5,578,089. The content of these documents mentioned is hereby incorporated by reference herein as to its full content in the disclosure of the present application, also for the purpose of including features of these documents in claims of the present application. The candle base material previously described, known in particular from the above-mentioned publications, is subsequently identified as candle base material of a first kind.

In addition, a candle base material is also proposed, which in addition to white oil—an oil which in the literature is also known as hydrocarbon oil—and copolymers, also comprises synthetic paraffins, in particular synthetic paraffins of chain length from C18 to C20. In addition, the chain lengths C21 to C25 are for example also possible, in particular cases also shorter chain lengths, C17 and less. In regard to a candle base material of this kind, which has chain lengths of the synthetic paraffin other than C18 to C20, an independent significance is also given. By synthetic paraffins, there is understood such paraffins as are extracted in the Fischer Tropsch process. On the one hand, it is thereby achieved that the candle has a closer relationship to conventional paraffin candles. In addition however, it has surprisingly also been achieved that there is introduced a change from transparent to opaque and also the reverse, the change is reversible, in dependence on a specific temperature, the change temperature. As long as the candle base material or the candle is at a temperature lower than the change temperature, the candle base material or the candle body made from the base material is opaque.

When this temperature is exceeded, a substantially completely clear, see-through candle base material or a like candle appears after a transition state. This may be advantageous in a variety of respects. The candle may also serve as a temperature indicator. On the other hand, when the candle is burning in a cooler environment, a change from opaque to see-through appearing more speedily towards the burning region may be observed. This is also tied in with corresponding light effects. The candle body has a characteristic corresponding to that of a conventional paraffin candle. It is also in particular self-supporting, even with increased addition of the paraffins mentioned. On the other hand, the candle may however also be formed for example in a shell, preferably also in a transparent glass body, by accommodation of the candle base material in the shell. The candle body is penetrated centrally by a wick, as a rule in conventional manner (the wick may be dispensed with in certain circumstances, in which burning away of the candle does not occur, but for example also by means of an associated or even fully incorporated electrical light source, which gives it aesthetic aspects, it may be brought into effect on a permanent basis).

Addition of the copolymers mentioned is also relevant to the structure of the candle body. In particular, various polymers may be used here, for example diblock, triblock, radial block and multi-block copolymers. Especially preferred is the use of a copolymer known as "Kraton G". There is a thermoplastic rubber. In so far as the candle body thus formed is not solid, it has a gel-like structure.

The composition of the candle base material may vary to a great extent within the general teaching of the present application. It is relevant that together a fraction of white oil and the synthetic paraffins mentioned is in the region of approximately 60 to 95%. Depending on the fraction of synthetic paraffins present, the change temperature varies. The higher the fraction of synthetic paraffins, the higher the change temperature. When the fractions are substantially equally important, each thus amounting to approximately 50%, the change temperature is approximately 20°. For a fraction of synthetic paraffins of approximately 90%, the change temperature is approximately 30°. For a fraction of synthetic paraffins of approximately 10%, the change temperature is approximately 6° C.

In addition to the synthetic paraffins mentioned, still further substances may also be added to the candle base material, either individually or in combination. In particular, these may include poly-alpha-olefins, low melting point paraffin fractions, and products derived from natural fats and oils and produced by chemical conversion, such as for example butyl stearate. The poly-alpha-olefins may also be present instead of the synthetic paraffins mentioned. The same also applies to low melting point paraffin fractions and to the products derived from the natural fats and oils mentioned and produced by chemical conversion. These are for example stearic acid butyl ester, lauric acid methyl ester (trade name Edenor MEC 12 98/100), caprylic acid triglyceride (Myritol 312). Along with these synthetic products, natural fats and oils (such as for example coconut oil) may also be used. The previously described candle base material originating from German Patent Application 197 51 351 (and the parallel PCT Application PCT/EP98/07300) mentioned is subsequently also referred to as candle base material of a second kind.

According to the present invention, there is now initially provided a candle consisting of a candle base material of the second kind in one of the embodiments previously described in combination with a candle base material consisting of conventional paraffin, also referred to as wax, i.e. a paraffin derived from crude paraffins. The candle base material derived from conventional paraffin is from now on referred to as a candle base material of a third kind.

The candle base materials of the second and third kind may for example be arranged alternately in layered manner over the height of a candle. They may however also be arranged in spiral manner side by side over the height of the candle. In addition, a mixture or a suspension of the candle base materials is also possible, and this need not be limited to the previously individually discussed candle base materials of the second and third kind, may also be in any desired combination with the candle base material of the first kind.

It is further provided according to the invention that a candle base material of the second kind is combined with a candle base material of the first kind. The candle base material of the first kind is therefore permanently transparent, independent of the temperature. There is in question in the case of this permanently transparent candle base material therefore a gel, the consistency of which is controlled by changing the fraction, the proportion and the kinds of certain polymers, preferably of tri-block, radial block and/or multi-block copolymers, in order to obtain a gel which has the desired rheological properties and thereby yields a candle base material which is solid in itself. While this candle base material of the first kind is fully transparent, it can however be given a coloration, as also further described below in connection also with the further candle base materials, by the use of one or more coloring agents. A tri-block, radial block and/or multi-block copolymer, optionally in conjunction with a di-block copolymer, provides a rigidly cross-linked, stiff gel. The embodiment is achieved by the block copolymers providing a three-dimensional network by physical cross-linkages. The cross-linkages occur in these block copolymers by the formation of submicroscopic small particles of a particle block, which may also be referred to as domains. The cross-linkage of these permanent domains may also be achieved by factors which influence the cross-link density of the network, including the length of permanent block domains, the length of releasable block domains and the number of cross-linked locations. For example, branched or star-form polymers and other multi-block copolymers have more cross-links than tri-block or di-block polymers. The kind of solution or plastification medium to which the blocks are subjected may also likewise influence these characteristics.

In particular, such a candle base material of the first kind may have from 93 to 98 weight percent of hydrocarbon oil (white oil) and from 7 to 10 weight percent of a copolymer selected from the group of tri-block, radial block and multi-block copolymers, and from 0 to approximately 10 weight percent of a di-block copolymer. The candle base material may also have from 70 to 98 weight percent of hydrocarbon oil (white oil), from 2 to 3 weight percent of a copolymer selected from the group consisting of tri-block, radial block and multi-block copolymers, and from 0 to 10 weight percent of a di-block copolymer.

In a further, optionally also alternative embodiment, this candle base material of the first kind may consist of a clear gel having from 80 to 99 weight percent of hydrocarbon oil (white oil) and from 1 to 20 weight percent of a mixture of at least two different polymer elements, selected from the group which consists of di-block copolymers, tri-block copolymers, radial block copolymers and multi-block copolymers, which composition may have at least one di-block copolymer and at least one tri-block copolymer, and the di-block and tri-block polymers further having portions of styrene monomer units and rubber monomer units.

The at least one di-block copolymer or the at least one tri-block copolymer has from 1 to 99 weight percent of the mixture of at least two different polymers.

The di-block polymers and the tri-block copolymers are derived from thermoplastic rubber.

The candle may also consist of more than two candle base materials, for example the candle base material mentioned of the third kind and/or the candle base material mentioned of the first kind being combined together (the latter if conceptually initially the candle base materials of the second and third kind are under discussion).

In addition, it is in particular also of significance that one or more of the candle base materials mentioned may be given coloration in a candle. In particular, coloration may be provided by a dye, the coloration of which changes in dependence on temperature. Such dyes are referred to here as so-called thermo-dyes, which for example under the trade name "Chromcolor" are distributed by Matsui Shikisu Chemie Limited/Japan. There may also be in question in particular a mixture of micro-encapsulated dyes with paraffin or also polyethylene.

The admixture of a dye, the coloration of which changes in dependence on temperature, thus a thermo-dye, also has significance for a candle which consists of only one of the candle base materials described, which is therefore then given coloration by means of this dye. For example, a candle from a permanently transparent gel may be given coloration by means of a thermo-dye which has a bluish color tone below a specific temperature, indicating coldness, and has a reddish color tone, indicating warmth, above a specific temperature.

By the candle base material of the first kind being thermally reversible, but the candle base material of the second kind enabling also straightforward mixing with dyes and/or scents (in contrast to candle base materials which are based on for example a polyamide resin, which hardens out and the reaction of which can then no longer be made reversible), the mixture is not limited to the dyes described previously, which change their coloration in dependence on temperature.

Some examples of candles with regard to the candle base materials contained in them are described below:

EXAMPLE 1

The candle has initially a candle base material of the second kind, consisting of:

| |
|---|
| 44.5% white oil |
| 44.5% synthetic paraffin C8–C20 |
| 6.0% Kraton G 1650 |
| 5.0% butyl stearate. |

Such a candle base material has the following properties: at a temperature of approximately 10° C., it is opaque as regards the paraffin and is solid. At approximately 18° C., a change from opaqueness to transparency begins. At approximately 20° C., a clear candle base material develops from the transparent candle base material.

The candle thus has a candle base material of the first kind.

The candle base material of the first kind consists of a gel comprising a thermoplastic rubber known under the trade name KRATON, which is dissolved Drakeol-7, in different combinations and with different percentage proportions. This gel was produced by solution of the block copolymers specified in mineral oil at approximately 50 to 70° C. The solutions were then poured out into clear glass containers and cooled down. The results are given in the following Table.

| Mixture Number | Diblock (Weight %) (Kraton G-1702) | Triblock (Weight %) (Kraton G-1650) | Mineral Oil (White Oil) (Weight %) | BHT (Weight %) |
|---|---|---|---|---|
| 1 | 0 | 5 | 94.99 | 0.01 |
| 2 | 0 | 20 | 79.99 | 0.01 |
| 3 | 5 | 5 | 89.99 | 0.01 |
| 4 | 5 | 20 | 74.99 | 0.01 |
| 5 | 0 | 2 | 97.99 | 0.01 |
| 6 | 0 | 3 | 96.99 | 0.01 |
| 7 | 0 | 4 | 95.99 | 0.01 |

All of these mixtures have resulted in a solid, transparent gel and were usable in combination with the candle base material of the second kind to form a candle. In this, the mixtures 5 and 6 exhibited however a somewhat different characteristic. It was solid (not capable of being poured) but nevertheless soft and slightly transparent. The gels 2 and 4 were very hard.

EXAMPLE 2

A candle was prepared having a candle base material of the second kind with the following composition:

| |
|---|
| 50% white oil (00W 065)<br>43% poly-alpha-olefins<br>7% Kraton G 1650. |

This candle base material has the same properties as the candle base material of the second kind described previously for Example 1, but the change from opaqueness to transparency and finally to clear occurs only at 23° C.

The candle was further combined with a candle base material of the first kind, produced according to the following procedure:

A mixture was produced of approximately 84.99 weight percent Drakeol-7, approximately 15 weight percent Kraton 1650 tri-block copolymer and approximately 0.01 weight percent BHT and processing carried out as in Example 1. After the cooling step, the mixture was poured into a glass container as a candle base material of the first kind and a conventional candle wick was introduced into the gel. The candle base material of the second kind was then poured onto this. The resulting candle is partially clear (in its lower region) and partially initially opaque (in its upper region), but is however at a higher temperature (also) transparent.

EXAMPLE 3

A candle was produced consisting on the one hand of a candle base material of the second kind of the following composition:

| |
|---|
| 50% white oil (00W 065)<br>33% poly-alpha-olefins<br>10% butyl stearate<br>7% Kraton G 1650. |

There resulted again substantially similar properties, the change from opaqueness by way of transparency to clarity occurring however in this case in the temperature region from 10° C.

The candle further contained a candle base material of the first kind, obtained according to the following procedure:

A mixture was produced of approximately 89.99 weight percent Drakeol-7, approximately 8 weight percent Kraton 1650 tri-block copolymer, approximately 2 weight percent Kraton G-1702 di-block copolymer and approximately 0.01 weight percent BHT and processing carried out as in Example 1. After the cooling had been completed, the mixture was again poured into a transparent, green glass container and a conventional candle wick inserted and it was kept stationary until gelling had set in. The resulting candle base material of the first kind is clear and is suited to burning uniformly for several hours.

FURTHER EXAMPLES

In regard to the candle base material of the second kind, the following compositions were also formulated:

| | |
|---|---|
| a) | 40% white oil (00W 065)<br>10% C18–C20<br>33% poly-alpha-olefins<br>10% butyl stearate<br>7% Kraton G 1650. |

There are achieved in this case substantially similar properties as for the candle base material previously described under 3.

| | |
|---|---|
| b) | 40% white oil (00W 065)<br>53% low melting point paraffin fraction<br>7% Kraton G 1650. |

In this case, there results a change from opaqueness via transparency to clarity at approximately +30°.

| | |
|---|---|
| c) | 65% white oil (00W 065)<br>10% C18–C20<br>19% Myritol 312<br>6% Kraton. |

In this case, there results a change from opaqueness via transparency through to clarity at approximately 10° C.

| | |
|---|---|
| d) | 65% white oil (00W 065)<br>15% butyl stearate<br>10% C18/C20<br>8% Kraton G 1650. |

In regard to the candle base material of the first kind, the following mixtures have also been formulated:

a) A mixture of approximately 87.49 weight percent Drakeol-7, approximately 8 weight percent Kraton 1650 tri-block copolymer, approximately 4.5 weight percent Kraton G-1702 di-block copolymer and approximately 0.01 weight percent BHT. The process is carried out in corresponding manner to the process for producing the candle base material of the first kind described for Example 2. Before cooling down, the composition is poured out into a clear glass container and a conventional candle wick is inserted into the gel and the composition is held stationary until gelling has come completely into effect. The candle base material of the second kind is then poured onto it. The resulting candle was in its lower region again clear and transparent, and in its upper region, opaque at a lower temperature, but also transparent in this region at a higher temperature. As a candle base material of the second kind, there is used here those which are further mentioned above under "Further Examples" at a).

b) A mixture was produced of 91.39 weight percent Drakeol-7, approximately 8.5 weight percent Kraton 1650 tri-block copolymer, approximately 0.1 weight percent Kraton G-1702 di-block copolymer and approximately 0.01 weight percent BHT and prepared in regard to procedure as described above in Example 2 with respect to the candle base material of the first kind.

c) A mixture was produced of approximately 91.99 weight percent Drakeol-7, approximately 8 weight percent Kraton 1650 tri-block copolymer and approximately 0.01 weight percent BHT and prepared in regard to procedure as described above in Example 2.

Furthermore, the examples were also carried out by in each case adding also a candle base material of the third kind, consisting of conventional paraffin, also referred to as wax.

BRIEF DESCRIPTION OF THE DRAWINGS

With the above and other objects and other advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
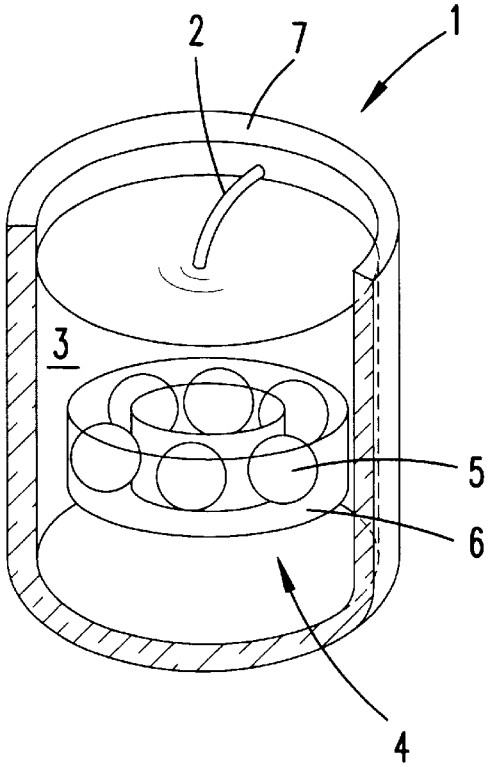
FIG. 1 shows a candle consisting of three different candle base materials.

There is initially shown and described a candle 1, which has in conventional manner a wick 2.

A first region 3 consists of a candle base material as further described above as a candle base material of a first kind. A second region 4 consists of a combination of candle base materials as further described above as candle base materials of a second and third kind. Simply for clarification of the possibilities resulting from this, the candle base material of the second kind is shown as forming balls 5, which are accommodated in an annular portion 6 which envelops the balls and consists of a candle base material as further described previously as a candle base material of the second kind.

The candle 1 consists therefore of a permanently transparent region 3 and of a body 6 accommodated within the region 3 which is transparent at low temperatures. When the temperatures rise or for example when the candle burns down, the structure of the region 6 breaks down optically, so that it also becomes transparent and the ball bodies 5 remain.

In addition, a transparent glass body 7 is provided which surrounds the region 3 and gives the candle structure.

Figure 2:
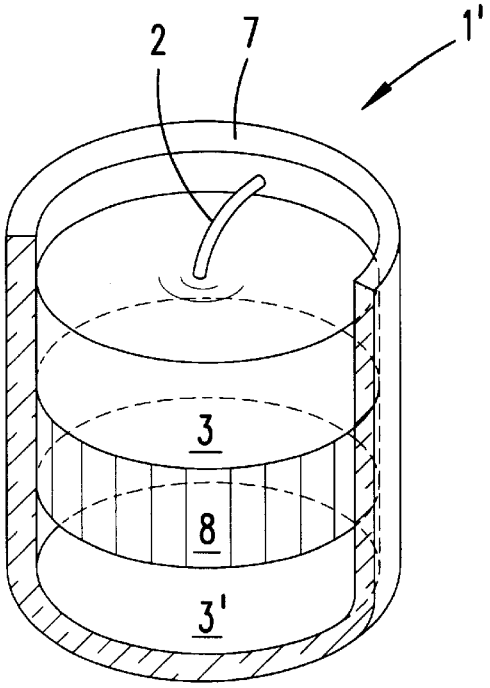
FIG. 2 shows a candle consisting of different candle base materials, disposed one over another in layered manner.

In the example of FIG. 2, the candle 1' shown there has in comparable manner a wick 2 and a glass body 7, provided in the form of a beaker.

In the interior, there is provided in disc form and arranged one over the other, regions 3, 3' consisting of a candle base material of a first kind and a region 8' consisting of a candle base material of a second kind.

The region 8 may in particular also be provided at the base of the glass container. When the base is in addition also formed to be opaque, it may in this manner also be achieved that a message provided on the base by printing or a graphic provided there becomes visible only when the temperature at which the candle base material of the second kind changes from opaque to transparent is exceeded.

Figure 3:
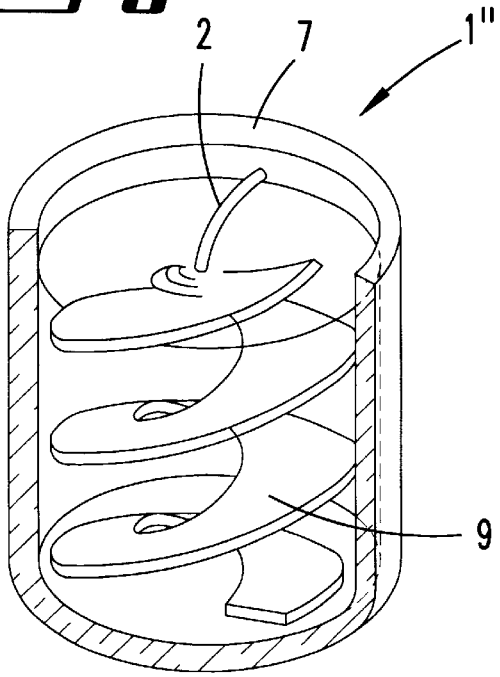
FIG. 3 shows a candle consisting of different candle base materials with arrangement of a candle base material in a spiral form.

In the example of FIG. 3, it is of significance that the candle 1" shown there has a candle base material of the second kind in the form of a spiral body 9. The spiral body 9 is introduced into the candle base material of the first kind. It may for example be produced by peripheral pouring of the spiral body 9. For the spiral body 9, there may also be in question for example a candle base material such as of the third kind.

In addition, the candle 1" may also be formed so that in place of the candle base material of the first kind, a candle base material of the third kind is provided and the spiral body 9 is formed from a candle base material of the first or second kind.

Figure 4:
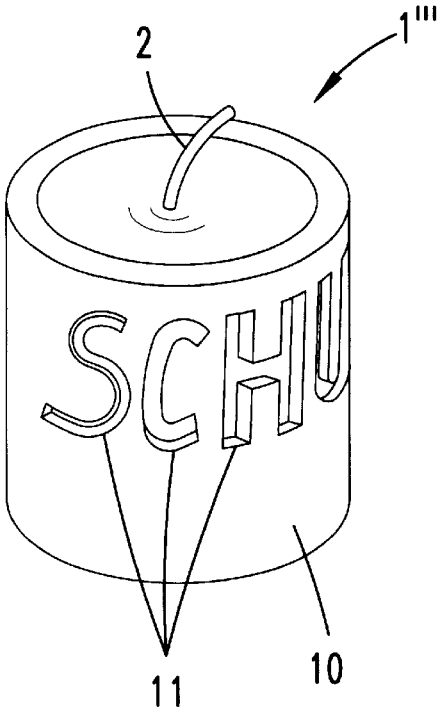
FIG. 4 shows a further candle according to FIG. 1 consisting of three candle base materials, in which windows are formed in the candle base material defining the outer sheath, the windows being filled by a candle base material of a further kind.

For the candle 1'" shown in FIG. 4, there is provided an outer, cylindrically-shaped structure body 10, likewise also having a base, the body being of a candle base material of the third kind. In the structure body 10, windows 11 are formed, which are provided in the embodiment as script symbols. The structure body 10 is filled up in the interior with a candle base material of the first or second kind, so that either the script appears in a permanently transparent manner or for example only appears when a corresponding change in temperature is reached, or the candle reaches the change temperature in the course of burning down.

In addition, individual windows may also for example be provided by means of a candle base material of the second kind, others by contrast being filled with candle base material of the first kind. In this way, changing window features may be achieved in dependence on warming.

What is claimed is:

1. A candle comprising candle base materials of a first component and a second component, the first component including, in part, white oil, a copolymer, and synthetic paraffin of chain length C18 to C20, and a second component consisting essentially of conventional paraffin derived from crude paraffins, and wherein said first component and said second component are arranged one over the other in a layered manner.

2. A candle comprising candle base materials of a first component and a second component, the first component including, in part, white oil, and a copolymer, and a synthetic paraffin of chain length C18 to C80, said second component consisting essentially of a solid gel, wherein the gel is a transparent gel having between 70 and 98 weight percent hydrocarbon oil, and being of approximately 2 to 30 weight percent of a copolymer selected from the group which consists of tri-block, radial block and multi-block copolymers and of 0 to approximately 10 weight percent of a di-block copolymer.

3. A candle comprising at least two different candle base materials, a first of the base materials being a solid gel, the gel being a transparent gel having between 70 and 98 weight percent of hydrocarbon oil, of approximately 2 to 30 weight percent of a copolymer selected from the group which consists of tri-block, radial block and multi-block copolymers, of 0 to approximately 10 weight percent of a di-block copolymer; and wherein a second of the base materials comprises conventional paraffin derived from crude paraffins.

4. A candle according to claim 2, wherein the candle further has a candle base material of a third kind.

5. A candle according to claim 3, wherein the candle further has a candle base material of a third kind.

6. A candle according to claim 1, wherein one of the candle base materials is accommodated in the other candle base material in a form of a spiral body.

7. A candle according to claim 1, wherein the first and second candle base materials are disposed alternatingly in a spiral manner.

8. A candle according to claim 1, wherein at least one of the candle base materials contains a dye and/or a scent.

9. A candle according to claim 1, wherein at least one of the candle base materials has coloration by a dye which changes in dependence on temperature.

10. A candle according to claim 2, wherein a further candle base material is contained in the candle which is made of a conventional paraffin derived from crude paraffins.

11. A candle according to claim 1, wherein the candle further has a third candle base material.

12. A candle according to claim 2, wherein one of the candle base materials is accommodated in the other candle base material in a form of a spiral body.

13. A candle according to claim 3, wherein one of the candle base materials is accommodated in the other candle base material in a form of a spiral body.

14. A candle according to claim 2, wherein the first and second candle base materials are disposed alternatingly in a spiral manner.

15. A candle according to claim 3, wherein the different candle base materials are disposed alternatingly in a spiral manner.

16. A candle according to claim 2, wherein at least one of the candle base materials contains a dye and/or a scent.

17. A candle according to claim 3, wherein at least one of the candle base materials contains a dye and/or a scent.

18. A candle according to claim 2, wherein at least one of the candle base materials has coloration by a dye which changes in dependence on temperature.

19. A candle according to claim 3, wherein at least one of the candle base materials has coloration by a dye which changes in dependence on temperature.

20. A candle according to claim 2, wherein a further candle base material is contained in the candle which is made of a conventional paraffin derived from crude paraffins.

* * * * *